US007463745B2

(12) United States Patent
Miller, III

(10) Patent No.: US 7,463,745 B2
(45) Date of Patent: Dec. 9, 2008

(54) PHASE BASED FEEDBACK OSCILLATION PREVENTION IN HEARING AIDS

(75) Inventor: Scott Allan Miller, III, Lafayette, CO (US)

(73) Assignee: Otologic, LLC, Boulder, CO (US)

( * ) Notice: Subject to any disclaimer, the term of this patent is extended or adjusted under 35 U.S.C. 154(b) by 795 days.

(21) Appl. No.: 10/821,446

(22) Filed: Apr. 9, 2004

(65) Prior Publication Data

US 2005/0226447 A1 Oct. 13, 2005

(51) Int. Cl.
*H04R 25/00* (2006.01)

(52) U.S. Cl. ..... 381/318; 381/320

(58) Field of Classification Search ..... 381/312, 381/317–318, 320
See application file for complete search history.

(56) References Cited

U.S. PATENT DOCUMENTS

| | | | | |
|---|---|---|---|---|
| 5,402,496 | A | 3/1995 | Soli | 381/94.2 |
| 5,475,759 | A | 12/1995 | Engelbreston | 381/318 |
| 5,500,902 | A | 3/1996 | Stockham, Jr. et al. | 381/320 |
| 5,680,467 | A | 10/1997 | Hansen | 381/314 |
| 5,848,171 | A | 12/1998 | Stockham, Jr. et al. | 381/321 |
| 5,912,977 | A | 6/1999 | Gottschalk-Schoenig | 381/321 |
| 6,044,162 | A | 3/2000 | Mead et al. | 381/312 |
| 6,072,884 | A | 6/2000 | Kates | 381/318 |
| 6,072,885 | A | 6/2000 | Stockham, Jr. et al. | 381/321 |
| 6,097,823 | A | 8/2000 | Kuo | 381/312 |
| 6,104,822 | A | 8/2000 | Melanson et al. | 381/320 |
| 6,108,431 | A | 8/2000 | Bachler | 381/312 |
| 6,128,392 | A | 10/2000 | Leysieffer et al. | 381/318 |
| 6,134,329 | A | 10/2000 | Gao et al. | 381/60 |
| 6,151,400 | A | 11/2000 | Seligman | 381/317 |
| 6,163,287 | A | 12/2000 | Huang | 341/143 |
| 6,173,063 | B1 | 1/2001 | Melanson | 381/318 |

OTHER PUBLICATIONS

U.S. Appl. No. 60/499,755, filed Sep. 2003, Robert J. Fretz.*

* cited by examiner

*Primary Examiner*—Suhan Ni
(74) *Attorney, Agent, or Firm*—Marsh Fischmann and Breyfogle LLP

(57) ABSTRACT

A method for reducing oscillation of a feedback signal in a hearing aid and hearing aid configured according to the present method is provided. The method includes the steps of determining the phase of the feedback signal over a feedback path of the hearing aid and shifting only the phase of the feedback signal a predetermined amount, without modification of other signal characteristics, to achieve a non-zero net phase of the feedback signal over the feedback path such that oscillation of the signal is prevented. In one embodiment of the present method, the step of determining the phase may be performed at the time of fitting of the hearing aid to a patient. In another embodiment of the present method, the method includes the step of periodically determining the phase of the feedback signal over the feedback path such that the phase shifting may be performed based on the periodically determined phase.

35 Claims, 7 Drawing Sheets

PHASE BASED FEEDBACK OSCILLATION PREVENTION IN HEARING AIDS

FIELD OF THE INVENTION

The present invention relates to the field of hearing aid devices, and more particularly, to reducing oscillation of a feedback signal in a hearing aid based on the phase of the feedback signal.

BACKGROUND OF THE INVENTION

Hearing aids compensate for a patient's loss of hearing function by enhancing ambient acoustic sounds. This is done via detecting ambient acoustic signals, processing the signals according to a patient specific prescription, and delivering the processed signals to the patient in a manner that the patient perceives as sound. Hearing aids are often categorized into one of two types, namely conventional and implantable hearing aids. Implantable hearing aids may be further categorized into fully implantable devices and semi-implantable devices.

Conventional hearing aids typically include a microphone, amplifier, signal processor, and speaker and are worn behind the ear and/or in the ear canal of the patient. Semi-implantable hearing aids typically include, a microphone, amplifier, signal processor, and transmitter that are externally located and inductively transmit a processed audio signal to an implanted receiver and transducer. Fully implantable-hearing aids, on the other hand, locate the microphone, amplifier, signal processor, and transducer subcutaneously below a patients skin, e.g. typically in the mastoid process and/or middle ear cavity.

Unfortunately, hearing aid devices, such as those described above, are often subject to feedback oscillation, e.g. resonant phenomenon due to re-amplification of feedback signals having a net phase of zero degrees. In conventional devices, the feedback is most often provided over a feedback path leading through the air to the microphone where it is re-amplified by the amplifier located downstream from the microphone. In implanted devices, the feedback may be provided over different propagation paths to the microphone and amplifier, such as via the eardrum and middle ear canal or the bones and/or other parts of the skull. In this regard, feedback signals are reintroduced to the microphone of the hearing aid where they may be re-amplified again by the amplifier to create an oscillation. When feedback signals, audible or not, oscillate through the hearing aid, they produce an unpleasant noise or whistle detectable by the user and others in close proximity. Unfortunately, however, feedback oscillation is difficult to control because of the close proximity between the microphone and other components of the hearing aid, e.g. the amplifier.

Presently, two predominate methods exist to compensate for feedback signals in hearing aid systems. The first method involves using a filter to calculate the best set of filter coefficients for lowering the gain or power of the feedback signal at the offending frequency to prevent oscillation. This technique, however, suffers from the disadvantage of limiting the actual output power available for the hearing aid. In addition, it can also decrease the ability of the patient to clearly understand speech, especially when background noise is present, and/or the speech includes an accent.

The second method involves injecting a signal with the same behavior as the feedback signal only out of phase by about 180 degrees. The injected out of phase signal operates to cancel out the offending feedback signal. For instance, in one particular application of this method described in European Patent Application No. 0 415 677 a digital pseudo-noise signal is supplied to a digital filter and to a feedback path of the hearing aid. The noise signal provided to the digital filter and the feedback path is received at a summation point with the output of the summation point being provided as one input to a digital correlator, while the original noise signal is provided as the other input to the digital correlator. The individual delay stages of the digital correlator produce digital values that are used for adaptive optimization of the coefficients of the filter. This process causes continuous matching of the digital filter to the conditions of the feedback path for the hearing aid. In another application of this technique, a pulse generator is provided for feeding short individual pulses to the feedback signal path that are utilized to determine the impulse response of the feedback signal path. The impulse response is then used to measure the transfer function of the path and set the filter coefficients. The disadvantage of these techniques, however, is that they address the problem of feedback through reactive compensational responses, which helps, but does not solve the problem. A further disadvantage is a comparatively high cost of digital processing. For instance, one coefficient multiplication in the digital filter requires at least two more multiplications with variable factors for filter adaptation.

SUMMARY OF THE INVENTION

In view of the foregoing, a primary object of the present invention is to improve hearing quality for hearing aid users, referred to herein as patients. Another object of the present invention is to proactively compensate, rather than reactively compensate, for oscillation of feedback signals in hearing aids, including entirely and/or partially implantable hearing aids as well as conventional hearing aids. Another object of the present invention is to prevent oscillation of feedback signals without limiting the power of the hearing aid.

In accordance with a first aspect of the present invention, a method for reducing oscillation of a feedback signal in a hearing aid is provided. The method includes the steps of determining the phase of a feedback signal over a feedback path of a hearing aid and shifting the phase of the feedback signal a predetermined amount, without modification of signal gain characteristics, to achieve a non-zero net phase of the feedback signal over the feedback path.

In one embodiment of the subject first aspect, the phase of the feedback signal may be determined at the time of fitting of the hearing aid to the patient. In this regard, the phase may be determined over a frequency range of the hearing aid. Alternatively, the phase may be determined over only the frequency range where the signal gain is approaching one, equal to one, and/or greater than one to reduce the processing time and the processing steps. The phase determining step may be performed by any appropriate method for measuring the phase of a signal over the feedback path. For instance, the phase determining step may include the steps of generating and providing a test signal to the hearing aid, wherein the phase of the test signal is known, e.g. determined at a generation point (e.g. at a signal generator) of the test signal. In this regard, the test signal may be selected from a group of possible test signals to select a test signal based on the nature of the patient's hearing impairment such that the test signal is substantially undetectable by the patient. For instance, the test signal may be selected from the group including but not limited to sine waves, pseudorandom signals, white noise, and minimum excursion signals. Responsive to the test signal traversing the feedback path of the hearing aid, the determining step may include detecting the test signal and comparing the phase of the test signal at the generation point (e.g. a signal generator) with the phase of the test signal at the detection point to determine the phase over the feedback path.

In this regard, the method further includes the step of determining a set of filter coefficients that shift the phase of the feedback signal and the step of providing the feedback signal to a filter configured with the filter coefficients. According to this characterization, the filter may be a non-adaptive filter such that the coefficients are set at the time of fitting and periodically re-evaluated as necessary by an audiologist. Further in this regard, the step of shifting the phase of the feedback signal the predetermined amount may include the steps of determining the patient's ability to detect audio queues generated in response to the phase shift and determining/selecting the predetermined amount of the phase shift as a function of the patient's ability to detect the audio queues to minimize the patient's ability to detect the phase shift. In this characterization, the phase is preferably shifted to achieve a net phase over the feedback path of about 180 degrees. The phase may, however, be shifted in the range of 10 to 350 degrees, 45 to 315 degrees, 135 to 225 degrees, etc. to minimize the patient's ability to detect the phase shift.

According to a second embodiment of the subject first aspect, the step of determining the phase may include periodically determining the phase of the feedback signal during normal operation of the hearing aid and determining updated filter coefficients based on the periodically determined phase of the feedback signal. As with the above embodiment, the phase may be determined over a frequency range of the hearing aid, or alternatively, over a frequency range where the signal gain is approaching one, equal to one, and/or greater than one to reduce the processing time and processing steps. Further in this regard, the phase may be determined by generating and providing a test signal to the hearing aid and comparing the phase of the test signal at the point of generation and point of detection to determine the phase over the feedback path. According to this characterization, the filter may be an adaptive filter. In this case, the adaptive filter may utilize the previously utilized coefficients to generate new coefficients and/or may discard the previously utilized coefficients and generate new coefficients. Further in this regard, the step of shifting the phase of the feedback signal the predetermined amount may include the steps of determining the patient's ability to detect audio queues generated in response to the phase shift and determining/selecting the predetermined amount of the phase shift as a function of the patient's ability to detect the audio queues so as to minimize the patient's ability to detect the phase shift.

According to a second aspect of the present invention a method for reducing oscillation of a feedback signal in a hearing aid is provided. The method includes the steps of monitoring the hearing aid for favorable conditions for oscillation of the feedback signal and/or actual oscillation of the feedback signal. Responsive to detecting favorable conditions for oscillation of the feedback signal and/or oscillation of the feedback signal, the method includes the steps of determining the phase of the feedback signal and shifting the phase of the feedback signal a predetermined amount, without modification of signal gain characteristics to achieve a non-zero net phase of the feedback signal over the feedback path. In this regard, the phase shifting step may include determining updated filter coefficients based on the determined phase of the feedback signal and configuring a filter with the determined filter coefficients.

As with the second embodiment above, the step of determining the phase may also include, periodically determining, e.g. regardless of whether favorable conditions or oscillation exist, the phase of the feedback signal during normal operation of the hearing aid and determining the updated filter coefficients based on the periodically determined phase of the feedback signal. Also, as with the above embodiments, the phase may be determined over a frequency range of the hearing aid, or alternatively, over a frequency range where a signal gain is approaching one, equal to one, and/or greater than one, to reduce the processing time and processing steps. Further in this regard, the phase may be determined by generating and providing a test signal to the hearing aid and comparing the phase of the test signal at the point of generation and point of detection to determine the phase over the feedback path. In addition, the test signal may be selected from a group of possible test signals based on the nature of the patient's hearing impairment, such that the test signal is substantially undetectable by the patient. For such purposes, and by way of example only, the test signal may be selected from the group including but not limited to sine waves, pseudorandom signals, white noise, and minimum excursion signals.

According to this characterization, the filter may be an adaptive filter. In this case, the adaptive filter may utilize the previously utilized coefficients to generate new coefficients and/or may discard the previously utilized coefficients and generate new coefficients. Further, in this regard, the step of shifting the phase of the feedback signal the predetermined amount may include the steps of determining the patient's ability to detect audio queues generated in response to the phase shift, and determining/selecting the predetermined amount of the phase shift to minimize detection of the phase shift by the patient. For instance, as described above, the phase is preferably shifted to achieve a net phase over the feedback path of about 180 degrees, but may also be shifted in the range of 10 to 350 degrees, 45 to 315 degrees, 135 to 225 degrees, etc., to minimize the patient's ability to detect the phase shift.

According to a third aspect of the present invention, a hearing aid comprising a microphone, signal processor, transducer, and phase shifter logic is provided. The microphone is configured to receive audio inputs and provide a response signal to the signal processor. The signal processor, in turn, processes the response signal to generate a transducer drive signal, wherein a portion of one of the response signal and the transducer drive signal is received over a feedback path of the hearing aid as a feedback signal. The transducer utilizes the transducer drive signal to stimulate a component of the auditory system. The phase shifter logic, e.g. a filter, is configured to shift the phase of the feedback signal a predetermined amount, without modification of signal gain characteristics to achieve a non-zero net phase of the feedback signal over the feedback path.

In one embodiment of the subject third aspect, the phase shifter logic may be configured, e.g., a set of filter coefficients determined, at the time of fitting of the hearing aid to a patient. According to this characterization, the phase shifter logic may be a non-adaptive filter such that the coefficients are set at the time of fitting and periodically re-evaluated as necessary by an audiologist. Further in this regard, the phase shifter logic may be set such that the phase of the feedback signal is shifted a predetermined amount according to the patient's ability to detect audio queues generated by the phase shift so as to minimize the patient's ability to detect the phase shift. In this characterization, the phase is preferably shifted to achieve a net phase over the feedback path of about 180 degrees, but may also be shifted in the range of 10 to 350 degrees, 45 to 315 degrees, 135 to 225 degrees, etc., to minimize the patient's ability to detect the phase shift.

According to a fourth aspect of the present invention, a hearing aid is provided comprising the microphone, the signal processor, the transducer, the phase shifter logic, and an adaptive circuit. The adaptive circuit includes phase measurement logic for determining the phase of a feedback signal over a feedback path. In this characterization, the adaptive circuit is operational to periodically determine the phase of the feedback signal during normal operation of the hearing aid, and determine updated filter coefficients for the phase shifter logic based on the periodically determined phase of the feedback signal. As with the above embodiments, the phase may be determined over a frequency range of the hearing aid, or alternatively, over a frequency range where a signal gain is approaching one, equal to one, and/or greater than one. Further in this regard, the phase may be determined by generating and providing a test signal to the hearing aid and comparing the phase of the test signal at the point of generation and point of detection to determine the phase over the feedback path. According to this characterization, the adaptive circuit further includes a signal generator to generate and provide the test signal. In addition, the phase shifter logic may be an adaptive filter. In this case, the adaptive filter may utilize the previously utilized coefficients to generate new coefficients and/or may discard the previously utilized coefficients and generate new coefficients. Further, in this regard, the step of shifting the phase of the feedback signal the predetermined amount may include the steps of determining the patient's ability to detect audio queues generated in response to the phase shift and determining/selecting the predetermined amount of the phase shift to minimize the patient's ability to detect the phase shift.

According to a fifth aspect of the present invention, a hearing aid is provided comprising the microphone, the signal processor, the transducer, the phase shifter logic, and an adaptive circuit. According to this aspect, however, the adaptive circuit further includes oscillation detection logic to monitor the hearing aid for favorable conditions for oscillation of the feedback signal and/or actual oscillation of the feedback signal. Responsive to detecting favorable conditions for oscillation of the feedback signal and/or oscillation of the feedback signal, the detection logic causes the adaptive circuit to determine the phase of the feedback signal and generate updated filter coefficients for the phase shifter logic, based on the determined phase, that shift the phase of the feedback signal to achieve a non-zero net phase over the feedback path.

In this regard, the phase over the feedback path may also be determined periodically, e.g. regardless of whether favorable conditions or oscillation exist, during normal operation of the hearing aid and updated filter coefficients based on the periodically determined phase of the feedback signal provided to the phase shifter logic. Also, as with the above embodiments, the phase may be determined over a frequency range of the hearing aid or alternatively, over a frequency range where a signal gain is approaching one, equal to one, and/or greater than one. Further in this regard, the phase may be determined by generating and providing a test signal to the hearing aid and comparing the phase of the test signal at the point of generation and point of detection to determine the phase over the feedback path. In addition, the test signal may be selected from a group of possible test signals to select a test signal based on the nature of the patient's hearing impairment that is substantially undetectable by the patient, e.g. the test signal may be selected from the group including but not limited to sine waves, pseudorandom signals, white noise, and minimum excursion signals.

Those skilled in the art will appreciate how the above-described features may be combined to form numerous additional examples of the present invention. Furthermore, additional aspects and advantages of the present invention will become apparent to those skilled in the art upon consideration of the following figures and description.

BRIEF DESCRIPTION OF THE DRAWINGS

The same reference number represents the same element on all drawings.

DETAILED DESCRIPTION

Reference will now be made to the accompanying drawings, which at least assist in illustrating the various pertinent features of the present invention. In this regard, the following description of a hearing aid device is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
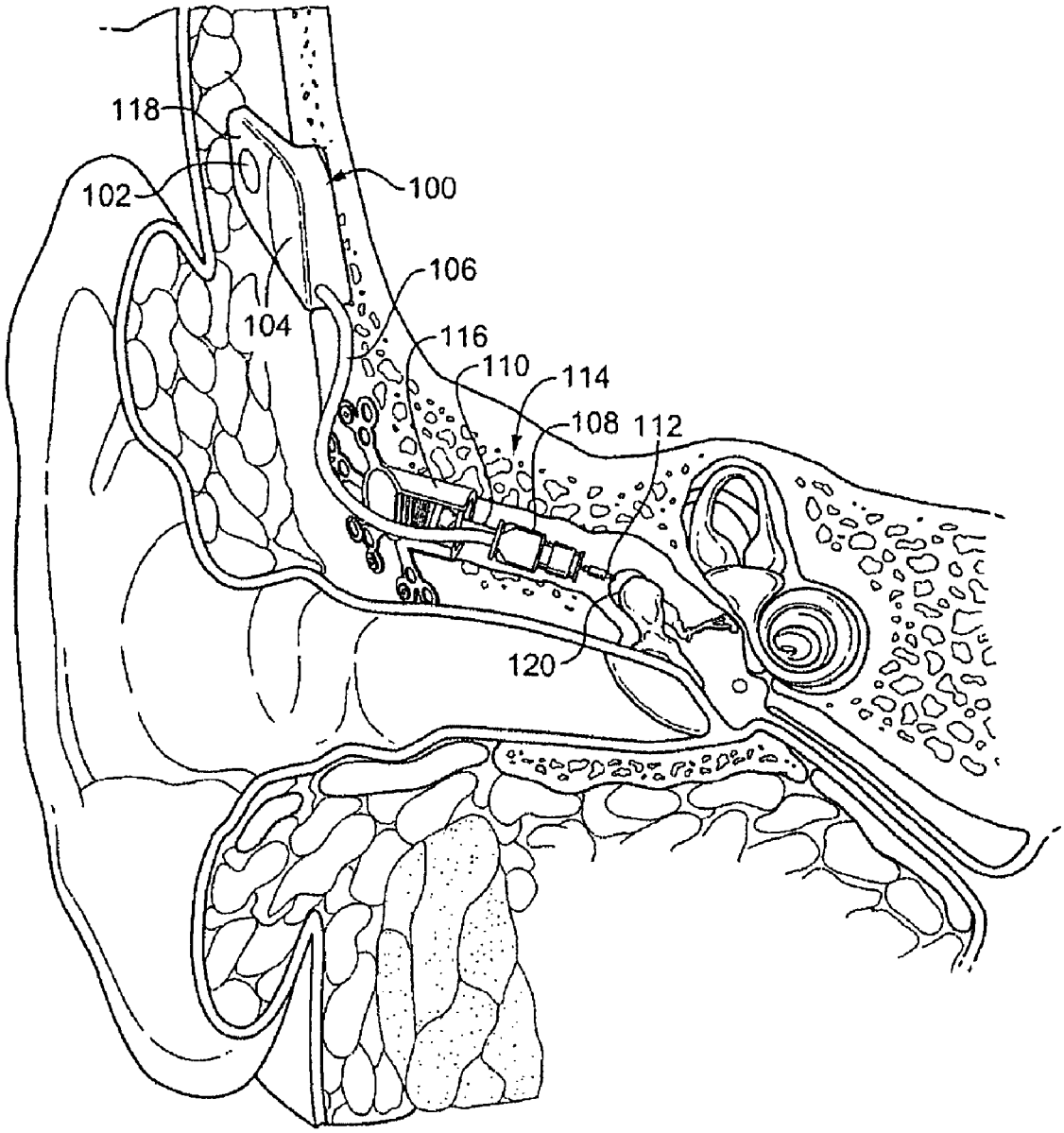
FIGS. 1 and 2 illustrate implantable and external componentry respectively, of an example of a semi-implantable hearing aid system.
Figure 2:
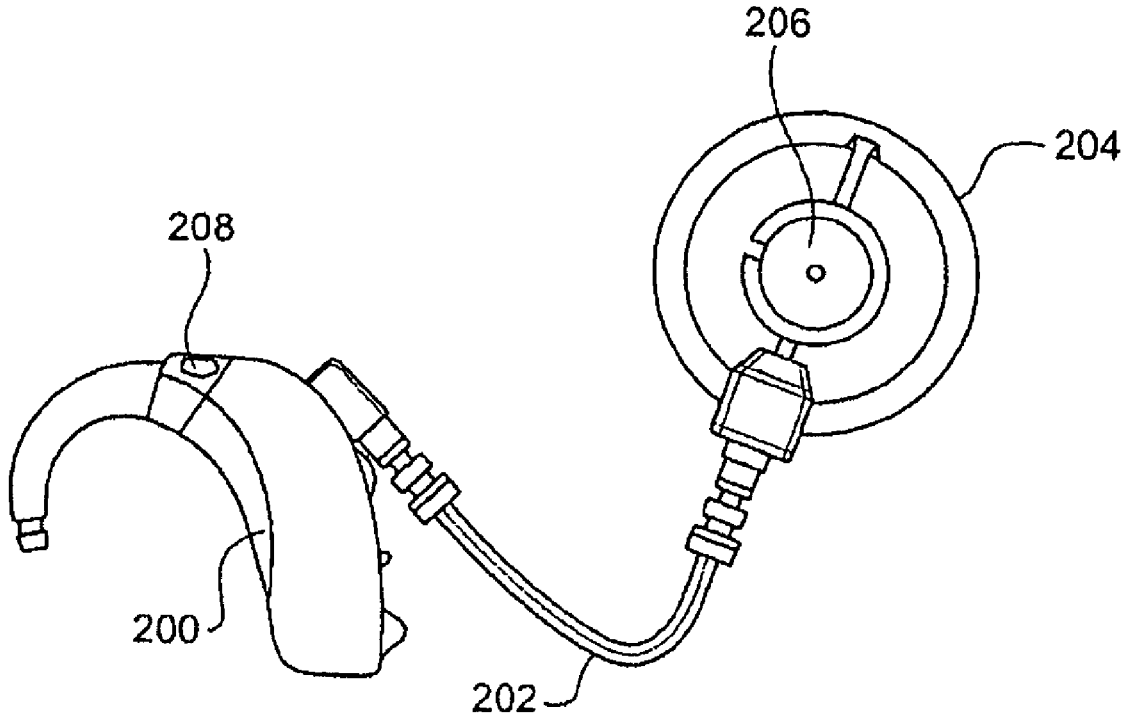

Hearing Aid System:

FIGS. 1 and 2 illustrate one application of the present invention. The illustrated application comprises a semi-implantable hearing aid system having implanted components shown in FIG. 1, and external components shown in FIG. 2. As will be appreciated, the present invention may also be employed in conjunction with conventional hearing aids and fully implantable hearing aids.

In the illustrated system, an implanted biocompatible housing 100 is located subcutaneously on a patient's skull. The housing 100 includes an RF signal receiver 118 (e.g. comprising a coil element) and a signal processor 104 (e.g. comprising processing circuitry and/or a microprocessor). The signal processor 104 is electrically interconnected via wire 106 to an electromechanical transducer 108. As will become apparent from the following description, various processing logic and/or circuitry may also be included in the housing 100 as a matter of design choice.

The transducer 108 is supportably connected to a positioning system 110, which in turn, is connected to a bone anchor 116 mounted within the patient's mastoid process (e.g. via a hole drilled through the skull). The electromechanical transducer 108 includes a vibratory member 112 for transmitting axial vibrations to a member of the ossicular chain of the patient (e.g. the incus 120).

Referring to FIG. 2, the semi-implantable system further includes an external housing 200 comprising a microphone 208 and internally mounted speech signal processing (SSP) unit (not shown). The SSP unit is electrically interconnected via wire 202 to an RF signal transmitter 204 (e.g. comprising a coil element). The external housing 200 is configured for disposition around the rearward aspect of the patient's ear. The external transmitter 204 and implanted receiver 118 each include magnets, 206 and 102, respectively, to facilitate retentive juxtaposed positioning.

During normal operation, acoustic signals are received at the microphone 208 and processed by the SSP unit within external housing 200. As will be appreciated, the SSP unit may utilize digital processing to provide frequency shaping, amplification, compression, and other signal conditioning, including conditioning based on patient-specific fitting parameters. In turn, the SSP unit via wire 202 provides RF signals to the transmitter 204. Such RF signals may comprise carrier and processed acoustic drive signal portions. The RF signals are transcutaneously transmitted by the external transmitter 204 to the implanted receiver 118. As noted, the external transmitter 204 and implanted receiver 118 may each comprise coils for inductive coupling signals there between.

Upon receipt of the RF signals, the implanted signal processor 104 processes the signals (e.g. via envelope detection circuitry) to provide a processed drive signal via wire 202 to the electromechanical transducer 108. The drive signals cause the vibratory member 112 to axially vibrate at acoustic frequencies to effect the desired sound sensation via mechanical stimulation of the ossicular chain of the patient.

By way of background, it fundamentally applies that in a closed loop system such as hearing aid system 100, a signal becomes unstable when the loop gain exceeds 1. Unfortunately, however, before this limit is reached, at frequencies where the loop gain approaches 1, resonant phenomenon can occur due to re-amplification of feedback signals having a net phase of zero degrees. Such resonant phenomenon is usually manifested to the patient, e.g. user of the hearing aid 100, in the form of an unpleasant whistling, which may also be heard by others in proximity to the patient. Therefore, in the prior art, it is conventionally believed that the loop gain should always remain less than 1. This, however, conflicts with the fact that, depending on the severity of the hearing damage of the patient, very high gains are necessary under certain circumstances. Advantageously, the present method is proactive in reducing the occurrence of oscillation of a feedback signal in a hearing aid, rather than subsequent to such oscillation reactively generating a canceling signal that compensates for the same. This in turn, provides among other advantages, the specific advantage of permitting an increase in the system loop gain to levels at or above one (1).

In this regard, the present invention reduces oscillation of feedback signals in hearing aid devices by measuring the phase of feedback signals over a feedback path at different frequencies. The phase of the feedback signals is then shifted, e.g. using a filter, without modifying other signal characteristics, e.g. frequency, gain and/or amplitude, to prevent the net phase of the feedback signals from ever being zero degrees, as required for oscillation. Advantageously, the present invention modifies only the phase of feedback signals so that the net phase of such signals is always non-zero and oscillation is reduced even at gains at or above one.

Figure 3:
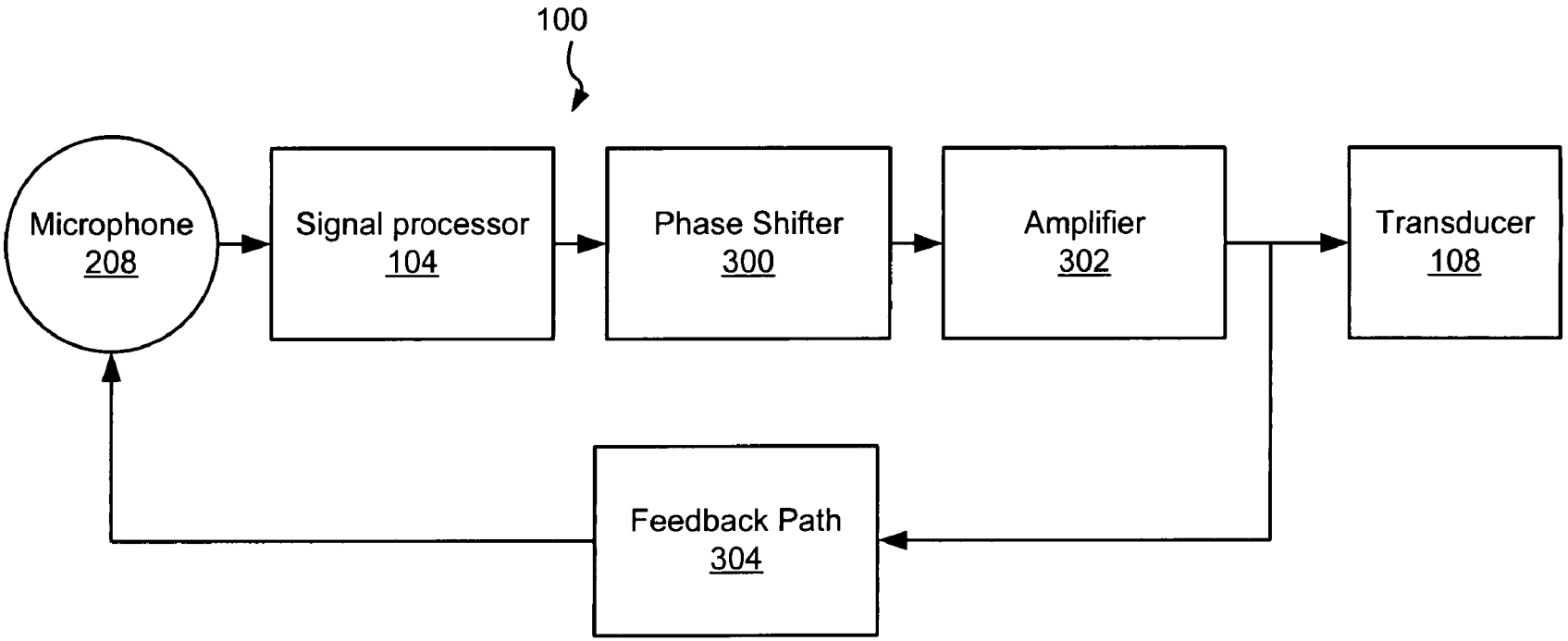
FIG. 3 illustrates a schematic representation of one embodiment of a hearing aid according to the present invention.

FIG. 3 illustrates a partial schematic representation of the hearing aid device 100 configured according to a first embodiment of the present invention. According to this embodiment, the hearing aid device 100 includes the microphone 208, the signal processor 104, the transducer 108, an amplifier 302, and a phase shifter 300. It will be appreciated, however, that the signal processor 104, the phase shifter 300, and the amplifier 302, may be part of the same device or circuitry as a matter of design choice, although such elements are shown individually on FIG. 1 for purpose of clarity.

In a hearing aid device, such as the deice 100, it usually cannot be avoided that at least a portion of the output signal from the amplifier 302 is provided back to the microphone 208 and ultimately the amplifier 302 via a feedback path represented on FIG. 3 by feedback path 304. The feedback path 304 may be a variety of paths according to the type of the hearing aid device 100. For instance, in a conventional hearing aid, the feedback path 304 typically leads through the air back to the microphone, while in an implanted hearing aid device there may be different propagation paths, such as, via the bones and/or other parts of the skull, or via the eardrum and ear canal.

In this characterization, the microphone 208 may be any device that receives ambient acoustic sounds and provides a representative output signal to the signal processor 104. The microphone 208 may be of a variety of types commonly used in the art. One example of the microphone 208 includes without limitation, an omni-directional microphone.

The signal processor 104 may be a digital signal processor or an analog signal processor as a matter of design choice. In this regard, the signal processor 104 may be any device or devices that processes the output signal from the microphone 208 according to patient specific processing parameters. The processing may include a number of steps, such as frequency shaping, compression, et cetera. The steps in the signal processing are typically determined by the design of the hearing aid 100, while the particular values used in the steps are generated from prescriptive processing parameters determined by an audiologist. It will be appreciated that where the signal processor 104 is a digital signal processor, other conventional components, such as an analog to digital converter and digital to analog converter (not shown) would also be included in the hearing aid system 100. The signal processor 104 provides the processed output signal to the phase shifter 300.

The phase shifter 300 may be any device or circuitry configured to modify or shift only the phase of a signal without modifying other characteristics of the signal, such as the frequency, amplitude and/or gain. For instance, the phase shifter 300 may be a conventional filter such as an all pass filter, which includes filter coefficients set to pass all frequencies to the filter output with no attenuation or amplification. In this regard, all such filters have an inherent phase response, e.g. phase lag, which changes with frequency such that a predeterminable filter design may be chosen to achieve a desired phase shift without altering other characteristics of the frequency. In another instance, the phase shifter 300 may be another type of filter such as an infinite impulse response filter ("IIR"), or a finite impulse response ("FIR") filter, which utilizes a transfer function, describing the filters frequency response, to perform signal shaping. In this case, a weighted sum of a finite set of inputs is utilized to generate the desired phase shift without modification of other signal characteristics. It should also be noted that the phase shifter 300 could also be any other similar device having the ability to modify or shift only the phase of an input signal passed there through.

Operationally, the phase of the feedback signals is preferably shifted such that a net phase of about 180 degrees is achieved over the feedback path 304. The degree of phase shifting, however, may also be determined by a patient specific parameter that is determined and set by an audiologist according to the severity of hearing loss of an individual patient, as this determines the patient's ability to detect audio queues generated by a phase shift. For instance, patients with sever hearing loss, are typically unable to detect the audio queues generated in response to a phase shift of a frequency. Thus, for a patient with severe hearing loss, the amount of phase shift required to achieve a 180-degree net phase difference is of less of a concern, as the patient is unable to detect the audio queues generated by a more significant phase shift. Alternatively, however, for patients with less severe hearing loss, the amount of the phase shift may be reduced according to the patient's ability to detect the audio queues generated by the phase shift. This in turn, maintains the sound quality perceived by the patient. For instance, in such a patient, the phase shift may only be enough to ensure that oscillation at that frequency cannot occur as opposed to a phase shift that achieves the desired 180-degree net phase difference. In other words in such a patient, the net phase of feedback signals over the feedback path 304 may only approach a 180 degree net phase difference. In this case, the phase shifter 300 may be set to shift the phase of signals at least 10 degrees and a maximum of 180 degrees according to the patient specific parameter, e.g. level of detection of audio queues generated by the phase shift for an individual patient.

The amplifier 302 may be any device or circuitry that processes the output signal from the phase shifter 300 to amplify the signal according to the prescriptive parameters of the hearing aid 100, e.g. as determined by an audiologist for an individual patient. In this regard, those skilled in the art will appreciate numerous examples of the amplifier 302 that may be included in the hearing aid device 100 as a matter of design choice.

Figure 4:
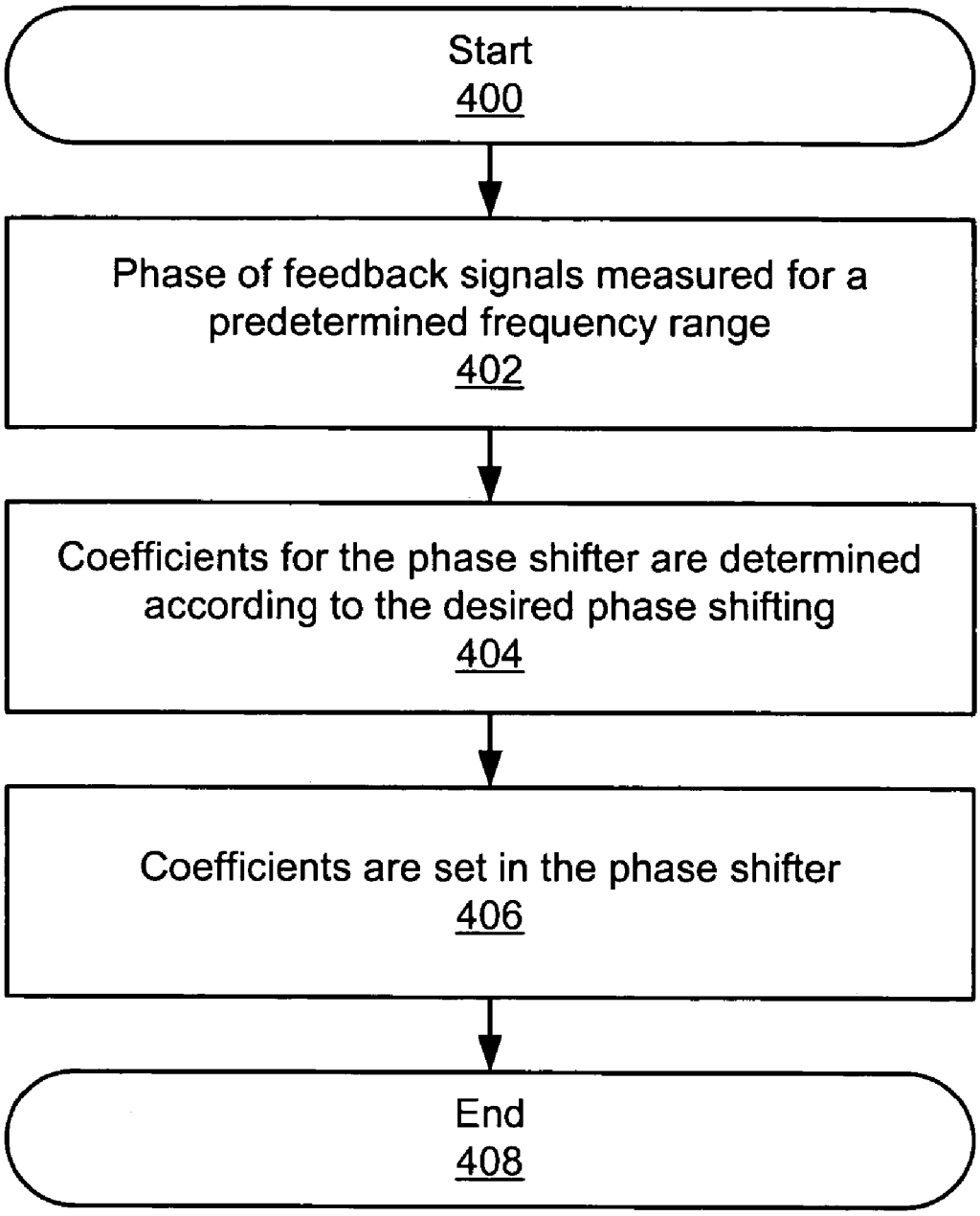
FIG. 4 is a flow chart illustrating an example of an operational protocol for the hearing aid of FIG. 3.

FIG. 4 is a flow chart illustrating an example of the operational protocol of the hearing aid device 100. According to this embodiment of the invention, the phase of feedback signals over the feedback path 304 are determined during fitting (including implantation of semi or fully implantable devices). In this regard, the phase of the feedback signals over the feedback path 304 may be determined for all or substantially the entire frequency range of the hearing aid device 100. Alternatively, however, the phase of the feedback signals may be determined in at least a frequency range where the gain is approaching, equal to, or greater than one, such that processing is simplified by focusing on the frequency range where oscillation is most likely to occur, e.g. where the loop-gain approaches 1. In one preferred example of this embodiment of the invention, the phase shifter 300 is an all pass filter having phase shifting coefficients set during the fitting process. It should be noted, however, that such coefficients may be reset as necessary at a later time following evaluation of the operation by an audiologist.

On FIG. 4, the operation begins at step 400. At step 402, an audiologist or other professional determines the phase of the feedback signals over feedback path 304 within a predetermined frequency range, e.g. the entire frequency range of the hearing aid device 100 or only the range where the gain approaches, is equal too or greater than 1. The phase measurement step 402 may be any process representative of determining the phase of feedback signals over the feedback path 304. For example, the phase measurement step 402 may be performed using a reference oscillator, a mixer, zero-crossing detector, scaler, and time interval counter as conventionally done in the art. In another example, the phase measurement process may include the use of a test signal having its phase measured from its point of generation to a point of detection after traversing the entire feedback path 304. In this case, a Fourier transform may be utilized to determine the phase, e.g. through determination of the frequency domain information according to conventional signal theory.

At step 404, coefficients for the phase shifter 300 are determined according to the desired amount of phase shifting. For instance as mentioned above, the phase is preferably shifted such that about a net 180 degree phase difference exists over the feedback path 304, but may be shifted as little as 10 degrees and as much as 180 degrees, such that the net phase approaches the 180 degree phase difference, but sound quality is not reduced for the patient. In other words, the filter coefficients for the phase shifter 300 may be determined according to the patient specific parameters to achieve as close to a 180 degree net phase difference as possible, while taking into consideration the level of detection by the patient of the audio queues generated in response to the phase shifting.

At step 406, the coefficients are set in the phase shifter 300 and the process ends at step 408. It should be noted that in relation to the above example, the coefficients are fixed in the phase shifter 300 at the time of fitting. Thus, it may be desirable to reevaluate the coefficients after a short time period following the fitting process. This is especially true in the case of implantable hearing aids, where tissue healing and other changes are likely to affect the characteristics of the hearing aid 100, until a steady state is reached. Thereafter, the determined filter coefficients may be utilized and only periodically reevaluated, e.g. during scheduled check ups with the audiologist.

Figure 5:
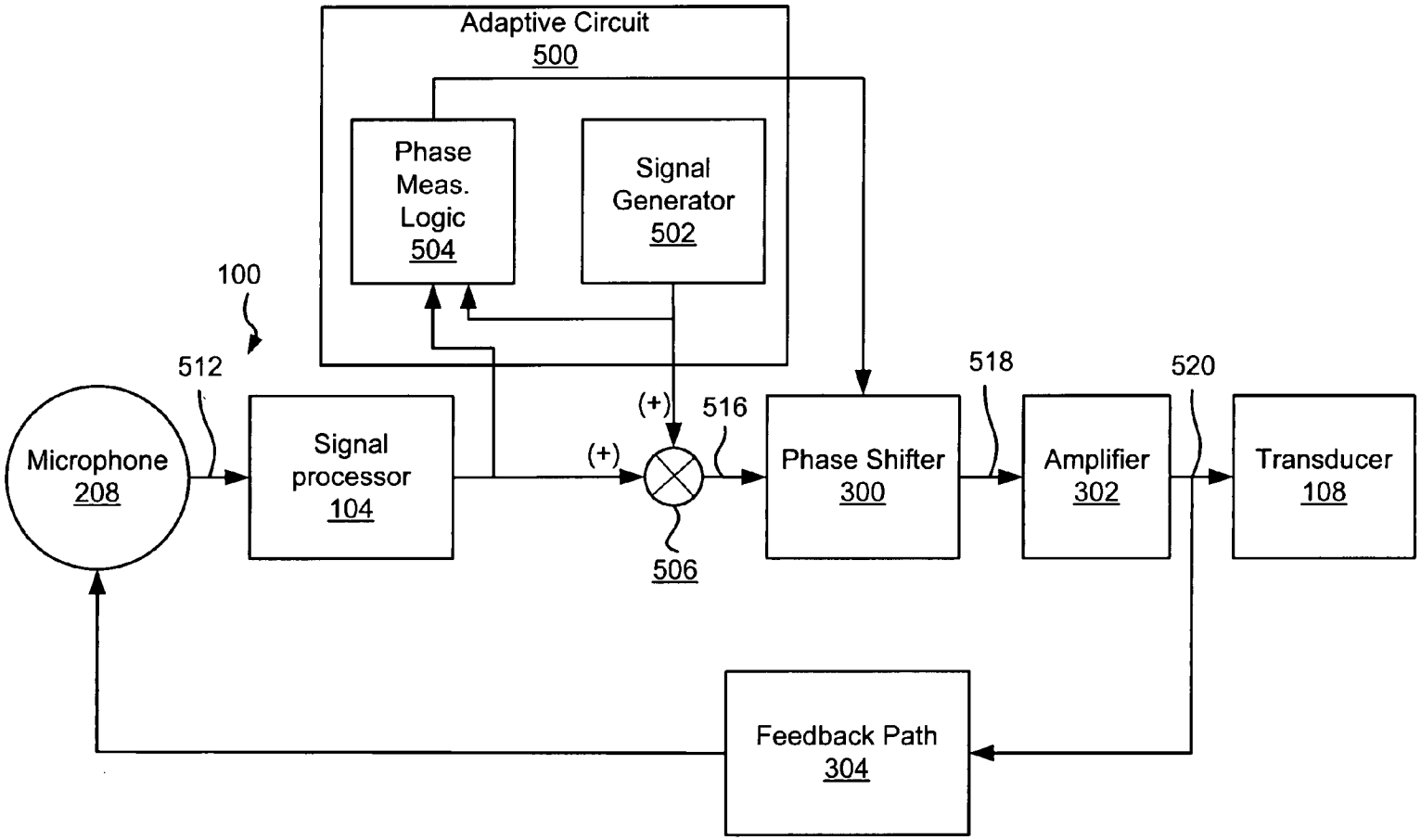
FIG. 5 illustrates a schematic representation of another embodiment of a hearing aid according to the present invention.

FIG. 5 illustrates a partial schematic representation of the hearing aid device 100 configured according to a second embodiment of the present invention. According to this embodiment of the invention, the hearing aid device 100 includes the microphone 208, the signal processor 104, the phase shifter 300, the amplifier 302, the transducer 108, and an adaptive circuit 500. In this characterization, the adaptive circuit 500 operates to continually determine the phase of feedback signals over the feedback path 304 such that phase shifting coefficients in the phase shifter 300 may be continuously updated to prevent a zero net phase over the feedback path 304. In other words, the adaptive circuit 500 is operational to dynamically optimize, during normal operation of the hearing aid 100, the phase shifting coefficients of the phase shifter 300.

The adaptive circuit 500 includes a signal generator 502 and phase measurement logic 504. The phase measurement logic 504 and signal generator 502 operate to provide and measure the phase of a test signal that has traversed the feedback path 304 from the signal generator 502 to the phase measurement logic 504. In other words, the adaptive circuit 500 provides test signals to the hearing aid 100 to generate impulse responses over the feedback path 304 that are utilized to measure the phase of feedback signals over the path 304 such that phase shifting may be performed to prevent the net phase from ever being zero degrees.

Specifically, the signal generator 502 is operative to generate and provide the test signal to a summation node 506 and the phase measurement logic 504. The phase measurement logic 504, in turn, registers the test signal for use in determining a transfer function of the feedback path 304 and ultimately the phase of the test signal as further described below. In this regard, the test signal provided to the summation node 506 traverses the signal paths 516-520 where at least a portion of the test signal traverses the feedback path 304 and is received by the microphone 208. The microphone 208 generates a microphone response signal over the path 512 which is processed by the signal processor 104 and provided back to the phase measurement logic 504. The phase measurement logic 504 compares characteristics of the original test signal provided by the signal generator 502 with characteristics of the test signal having traversed the feedback path 304 to measure the transfer function of the path 304 and phase of the feedback signal. Specifically, as mentioned above, a Fourier Transform may be utilized to determine the frequency domain information through comparison of the input test signal and the impulse response, or feedback signal, received back in the phase measurement logic 504. In other words, the phase of the feedback signal is determinable through comparison of the phase of the test signal, which is a known value at its point of generation, and the phase of the impulse response or feedback signal.

According to this embodiment of the invention, the phase shifter 300 is preferably an adaptive filter device such as an IIR filter and/or a FIR filter. These filters utilized a weighted sum of a finite set of inputs by multiplying an array of the most recent n data samples, e.g. most recent comparison of the test signal and feedback response signal, by an array of coefficients. The elements of the resulting array are then summed to determine the coefficients for the filter. Subsequent to another sampling, e.g. generation of another test signal, the filter inputs another set of n data samples and repeats the process to generate an updated set of coefficients, discarding the oldest data. It will be appreciated that the phase shifter 300 may be constructed such that the filter coefficients adjust only the phase of the feedback signal while permitting all frequencies to appear in the output signal with no attenuation or amplification. In this regard, the phase shifter 300 operates to perform phase shifting on an input signal such that the net phase over the path 304 is never zero degrees. In this regard, the adaptive circuit 500 provides continuous updated data to the phase shifter 300 through periodic sampling of the conditions of the feedback path 304, making the hearing aid 100 ideal for environments that are highly variable in time, as the hearing aid 100 adaptively compensates for changing conditions in the feedback path 304. For instance, such conditions of the feedback path 304 may be altered when the patient uses a telephone or the hearing aid 100 approaches some other form of sound reflecting device or amplification device.

According to the above principles, the test signal may take numerous forms as a matter of design choice. Some examples of the test signal include without limitation, sine waves, pseudorandom signals, white noise, and/or minimum excursion signals. It should also be noted that the test signal need only cover enough of the frequency band such that the phase of the signals received over the feedback path 304 is determinable. Alternatively, however, the test signal may be a continuous signal, such as a pseudorandom noise, provided by the signal generator 502. In this characterization, the coefficients of the shifter 300 may be updated on a continuous basis for adaptation and compensation of changes in the feedback path 304. This is particularly advantageous in conventional hearing aids where frequent changes in the feedback signal often occur do to changes in the surrounding environment, such as approaching a sound-reflecting device as mentioned above.

Figure 6:
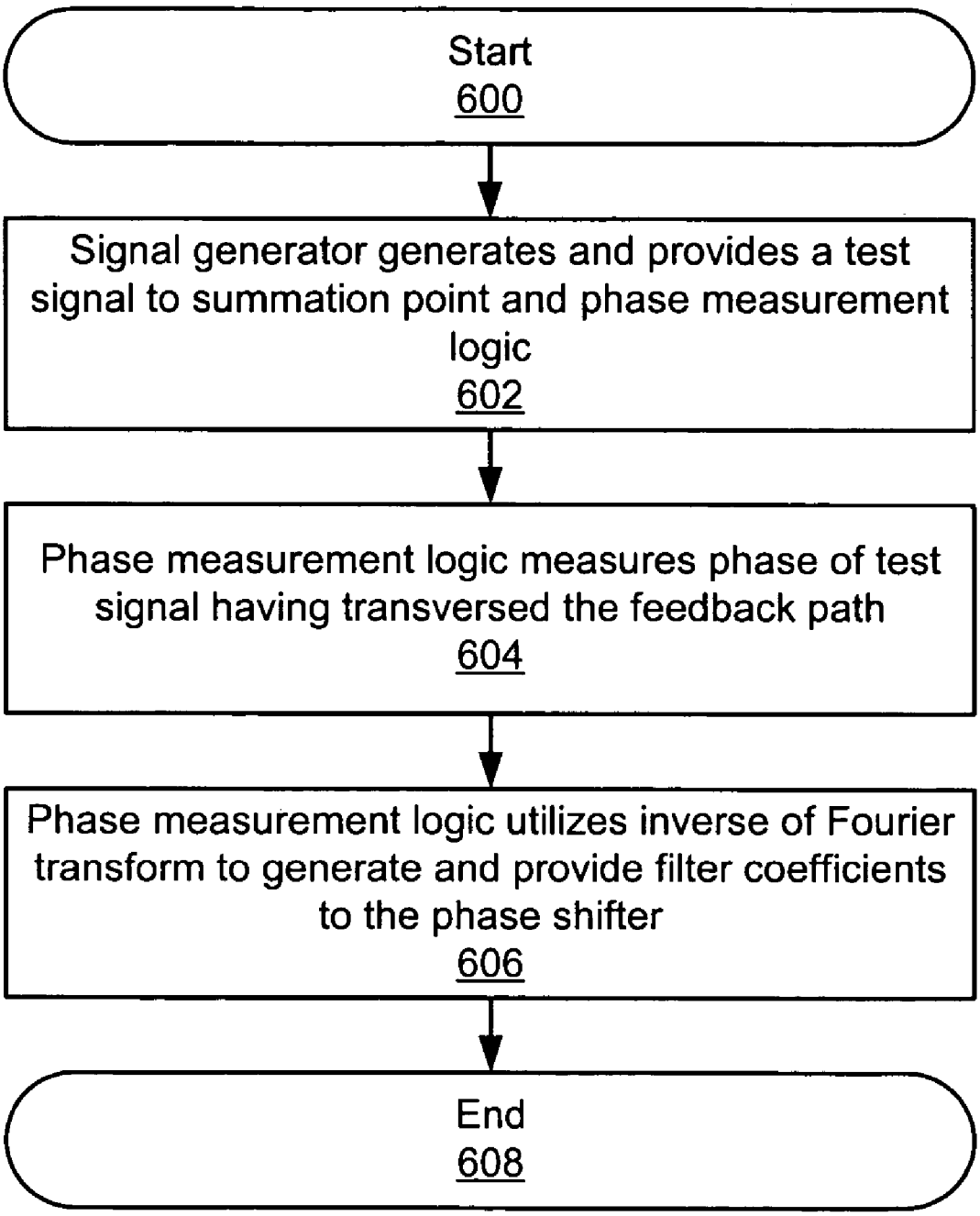
FIG. 6 is a flow chart illustrating an example of an operational protocol for the hearing aid of FIG. 5.

FIG. 6 is a flow chart illustrating an example of the operational protocol for the above-described embodiment. As with the previous embodiment, the hearing aid 100 compensates for feedback by shifting the phase of feedback signals at one or more frequencies so that the net phase of the feedback path 304 is never zero degrees. Additionally, as with the above embodiment, the phase shifter 300 preferably produces a phase response that approaches a 180-degree phase shift. Alternatively, however, the phase shifter 300 may perform phase shifting in the range of 10 to 350 degrees, 45 to 315 degrees, 135 to 225 degrees, etc., according to the patient specific parameters, e.g. the severity of hearing loss in the patient, to prevent the patient from detecting the audio queues produced by the phase shift.

On FIG. 6, the test and measurement operation begins at step 600. At step 602, the signal generator 502 generates and provides a test signal to the summation node 506 and the phase measurement logic 504. As mentioned above the test signal may be one of a variety of types of signals that covers enough of the frequency band to determine frequency domain information for the feedback path 304. It should be noted that there are numerous algorithms for determining the timing, of a testing process. Preferably, however, such algorithms take into consideration the disturbance caused to the patient by the testing, e.g. providing the test signal to the hearing aid 100. For instance, depending on the severity of hearing loss it may be possible in some cases to perform the testing at any time, as the test signal is undetectable by the patient. In other cases, however, the test signal may be provided at a time, such as startup of the hearing aid device 100, where a series of tones may already be utilized to indicate status information for the startup. It should also be noted, that the form of the test signal, e.g. sine waves, pseudorandom signals, white noise, and/or minimum excursion signals, may be determined on a patient specific basis so that the least detectable form of test signal is chosen according to the individual patients hearing condition.

Further, with regard to the testing event, consideration should be given to the likelihood of an external audio signal being received during testing. In the case where an external audio signal is not likely to be received during testing, a single test signal, e.g. a pulse, is sufficient to measure the transfer function of the feedback path 304. If however, it is likely that an external audio signal may be received, it is desirable to use the average of a large number of phase measurements taken during a test and measurement event, instead of a single measurement, to measure the transfer function of the feedback path 304. This provides the advantage of attenuating the affects of the external audio signal during testing, since such a signal(s) is not correlated with the test signals. Thus, the effect of such signals when averaging is used, is canceled over a sufficiently large number of measurements.

Continuing with the above example, the test signal(s) provided to the summation node 506 traverses the circuit path 516-520 wherein a potion of the output of the amplifier 302 is provided over the feedback path 304 to the phase measurement logic 504. At step 604, the phase measurement logic 504 measures the transfer function to determine the phase of the test signal. Specifically, the phase measurement logic 504 determines the frequency domain information using a Fourier transform as is well known in the art. At step 606, the phase measurement logic 504 utilizes the inverse of the Fourier transform, as is also well known in the art, to generate filter coefficients for the phase shifter 300 and the operation ends at step 608.

It should be noted that according to this embodiment of the invention, where the phase shifter 300 is an adaptive filter, such as a FIR or IIR filter, the phase shifter 300 could also be utilized to perform other signal processing steps that are normally done in the signal processor 104. For instance, conventional signal processing typically alters the gain at different frequencies according to the patient specific parameters. It will be appreciated, however, that a FIR or IIR filter may be designed that alters the gain according to the patient's parameters and performs the phase shifting to achieve a non-zero net phase over the feedback path 304.

Figure 7:
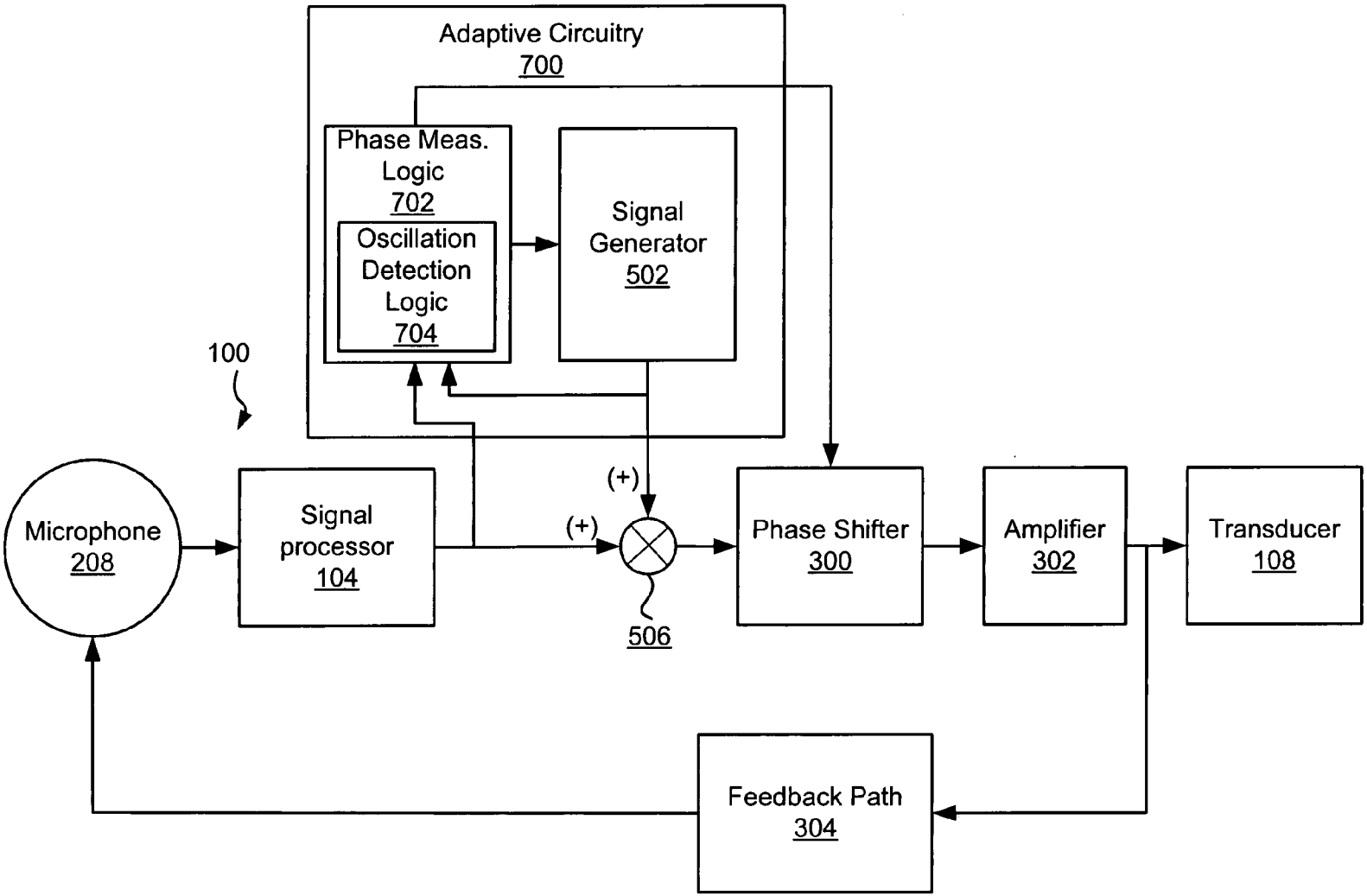
FIG. 7 illustrates a schematic representation of another embodiment of a hearing aid according to the present invention.

FIG. 7 illustrates a partial schematic representation of the hearing aid device 100 configured according to a third embodiment of the present invention. According to this embodiment, the hearing aid 100 includes the microphone 208, the signal processor 104, the phase shifter 300, the amplifier 302, the transducer 108, and an adaptive circuit 700. In contrast to the above embodiment, however, the adaptive circuit 700 includes the signal generator 502, and phase measurement logic 702 having oscillation detection logic 704. Operationally the adaptive circuit 700 not only performs periodic testing and measurement of the feedback path 304 as described above, but also uses the oscillation detection logic 704 to monitor the device 100 for feedback oscillation or favorable feedback oscillation conditions, to determine when such testing is necessary.

In this characterization, the oscillation detection logic 704 monitors the output signal from the signal processor 104 for conditions where feedback is detected or is likely to occur based on signal conditions. For instance, the oscillation detection logic 704 may include predetermined thresholds that define signal characteristics such as high amplitude or gain where feedback is likely to occur. In the event, such thresholds are exceeded, indicating that feedback exists or may occur, the oscillation detection logic 704 triggers a test event in the hearing aid 100. Specifically, the oscillation detection logic 704 provides an input signal to the signal generator 502 causing it to generate and provide a test signal (s) as described above. Thereafter, new filter coefficients for the phase shifter 300 are determined to prevent oscillation of the detected and/or likely to occur feedback during the period where the favorable feedback conditions exist.

The above-described elements can be comprised of instructions that are stored on storage media. The instructions can be retrieved and executed by a processing system. Some examples of instructions are software, program code, and firmware. Some examples of storage media are memory devices and integrated circuits. The instructions are operational when executed by the processing system to direct the processing system to operate in accord with the invention. The term "processing system" refers to a single processing device or a group of inter-operational processing devices. Some examples of processing systems are integrated circuits and logic circuitry. Those skilled in the art are familiar with instructions, processing systems, and storage media.

Those skilled in the art will appreciate variations of the above-described embodiments that fall within the scope of the invention. As a result, the invention is not limited to the specific examples and illustrations discussed above, but only by the following claims and their equivalents.

I claim:

1. A method for reducing oscillation of a feedback signal in a hearing aid, the method comprising the steps of:

determining a phase of a feedback signal over a feedback path of the hearing aid;

shifting the phase of an output signal of an implantable signal processor a predetermined amount, without modification of signal gain characteristics, to generate a phase-shifted output signal and achieve a non-zero net phase of the feedback signal over the feedback path; and applying the phase-shifted output signal to a transducer to stimulate an auditory component of a patient.

2. The method of claim 1 wherein the step of determining the phase comprises:

determining the phase of the feedback signal at the time of fitting the hearing aid to a patient.

3. The method of claim 1 wherein the step of determining the phase of the feedback signal comprises:

generating and providing a test signal to the hearing aid;

determining the phase of the test signal at a generation point of the test signal;

responsive to the test signal traversing the feedback path of the hearing aid, detecting the test signal; and comparing the phase of the test signal at the generation point with the phase of the test signal at the detection point to determine the phase of the feedback signal over the feedback path.

4. The method of claim 3 wherein the step of generating and providing the test signal comprises:

selecting a test signal that is substantially undetectable by the patient, from a group of possible test signals, based on the patient's hearing impairment.

5. The method of claim 4 wherein the step of selecting the test signal comprises:

selecting the test signal from the group comprising sine waves, pseudorandom signals, white noise, and minimum excursion signals.

6. The method of claim 3 wherein the step of shifting the phase comprises:

determining a set of filter coefficients that shift only the phase of the output signal; and providing the output signal to a filter configured with the filter coefficients.

7. The method of claim 6 wherein the step of determining the phase of the feedback signal comprises:

periodically determining the phase of the feedback signal during normal operation of the hearing aid; and determining updated filter coefficients based on the periodically determined phase of the feedback signal.

8. The method of claim 7, further comprising:

monitoring the hearing aid for one of conditions favorable to oscillation and oscillation of the feedback signal;

responsive to detecting one of conditions favorable to oscillation and oscillation of the feedback signal, determining the phase of the feedback signal; and determining the updated filter coefficients based on the determined phase of the feedback signal.

9. The method of claim 1 wherein the step of shifting the phase of the output signal of the implantable signal processor a predetermined amount comprises:

determining the patient's ability to detect audio queues generated by a phase shift; and determining the predetermined amount of phase shift, based on the patient's ability to detect the audio queues, to minimize detection of the phase shift by the patient.

10. The method of claim 9 wherein the predetermined amount of the phase shifting is in the range of 10 degrees to 350 degrees of phase shift.

11. The method of claim 1 wherein the step of shifting the phase of the output signal of the implantable signal processor a predetermined amount comprises:

shifting the phase of the output signal to achieve a net phase over the feedback path of about 180 degrees.

12. The method of claim 1 wherein the step of determining the phase comprises:

determining the phase of the feedback signal over a frequency range of the hearing aid.

13. The method of claim 1 wherein the step of determining the phase comprises:

determining the phase of the feedback signal over a frequency range where a signal gain is one of; approaching one, equal to one, and greater than one.

14. A method for reducing oscillation of a feedback signal over a feedback path in a hearing aid, the method comprising the steps of:

monitoring the hearing aid for at least one of conditions favorable to oscillation of a feedback signal and oscillation of the feedback signal;

responsive to detecting one of the conditions favorable for oscillation and oscillation of the feedback signal, determining the phase of the feedback signal;

shifting the phase of an output signal of an implantable signal processor a predetermined amount, without modification of signal gain characteristics, to generate a phase-shifted output signal and achieve a non-zero net phase of the feedback signal over the feedback path; and applying the phase-shifted output signal to a transducer to stimulate a component of the auditory system of a patient.

15. The method of claim 14 wherein the step of determining the phase of the feedback signal comprises:

generating and providing a test signal to the hearing aid;

determining the phase of the test signal at a generation point of the test signal;

responsive to the test signal traversing the feedback path of the hearing aid, detecting the test signal; and comparing the phase of the test signal at the generation point with the phase of the test signal at the detection point to determine the phase of the feedback signal over the feedback path.

16. The method of claim 15 wherein the step of generating and providing the test signal comprises:

selecting a test signal that is substantially undetectable by the patient, from a group of possible test signals, based on the patient's hearing impairment.

17. The method of claim 16 wherein the step of selecting the test signal comprises:

selecting the test signal from the group comprising sine waves, pseudorandom signals, white noise, and minimum excursion signals.

18. The method of claim 15 wherein the step of shifting the phase comprises:

determining a set of filter coefficients that shift only the phase of the output signal; and providing the output signal to a filter configured with the filter coefficients.

19. The method of claim 18 wherein the step of determining the phase of the feedback signal comprises:

periodically determining the phase of the feedback signal during normal operation of the hearing aid; and determining updated filter coefficients based on the periodically determined phase of the feedback signal.

20. The method of claim 14 wherein the step of shifting the phase of the output signal of the implantable signal processor the predetermined amount comprises:

determining the patient's ability to detect audio queues generated by a phase shift; and determining the amount of phase shift, based on the patient's ability to detect the audio queues, to minimize detection of the phase shift by the patient.

21. The method of claim 20 wherein the predetermined amount of the phase shifting is in the range of 10 degrees to 350 of phase shift.

22. The method of claim 14 wherein the step of shifting the phase of the output signal of the implantable signal processor a predetermined amount comprises:

shifting the phase of the output signal to achieve a net phase over the feedback path of about 180 degrees.

23. The method of claim 14 wherein the step of determining the phase comprises:

determining the phase of the feedback signal over a frequency range of the hearing aid.

24. The method of claim 14 wherein the step of determining the phase comprises:

determining the phase of the feedback signal over a frequency range where a signal gain is one of; approaching one, equal to one, and greater than one.

25. A hearing aid comprising:

a microphone to receive audio inputs and provide a response signal;

an implantable signal processor to process the response signal to generate a transducer drive signal, wherein a portion of one of the response signal and the transducer drive signal is received over a feedback path as a feedback signal;

a transducer to utilize the transducer drive signal to stimulate a component of the auditory system;

phase shifter logic, disposed in a path between the implantable signal processor and the transducer, to shift the phase of the transducer drive signal output from the implantable signal processor a predetermined amount, without modification of signal gain characteristics, to achieve a non-zero net phase of the feedback signal over the feedback path.

26. The hearing aid of claim 25 comprising:

adaptive circuitry to determine the phase of the feedback signal over the feedback path.

27. The hearing aid of claim 26 wherein the adaptive circuitry comprises:

a signal generator to generate and provide a test signal to the hearing aid; and phase measuring logic to determine the phase of the test signal at a generation point and responsive to the test signal traversing the feedback path of the hearing aid, compare the phase of the test signal at the generation point with the phase of the test signal at a detection point to determine the phase of the feedback signal over the feedback path.

28. The hearing aid claim 27 wherein the test signal is selected from a group of possible test signals, based on the nature of the patient's hearing impairment, to select a test signal that is substantially undetectable by the patient.

29. The hearing aid claim 28 wherein the test signal is selected from the group comprising sine waves, pseudorandom signals, white noise, and minimum excursion signals.

30. The hearing aid of claim 26 wherein the phase shifter logic includes a set of filter coefficients that shift only the phase of the transducer drive signal.

31. The hearing aid of claim 30 wherein the adaptive circuitry is configured to periodically determine the phase of the feedback signal during normal operation of the hearing aid and generate updated filter coefficients based on the periodically determined phase.

32. The hearing aid of claim 27 comprising:

oscillation detection logic to monitor the hearing aid and to provide a signal to the signal generator to generate the test signal responsive to detecting one of favorable conditions for oscillation of the feedback signal and oscillation of the feedback signal.

33. The hearing aid of claim 25 wherein the phase shifter logic is configured to shift the phase based on the patient's ability to detect audio queues generated by the phase shift to minimize the patient's detection of the phase shift.

34. The hearing aid of claim 25 wherein the phase shifter shifts the phase in the range of 10 degrees to 350 of phase shift.

35. The hearing aid of claim 25 wherein the phase shifter shifts the phase to achieve a net phase over the feedback path of about 180 degrees.

* * * * *

UNITED STATES PATENT AND TRADEMARK OFFICE

CERTIFICATE OF CORRECTION

PATENT NO. : 7,463,745 B2
APPLICATION NO. : 10/821446
DATED : December 9, 2008
INVENTOR(S) : Miller It is certified that error appears in the above-identified patent and that said Letters Patent is hereby corrected as shown below:

Title Page, Item (73) Assignee: delete “Otologic” and insert therefor --Otologics--.

Column 16, line 35, after “aid”, insert therefor --of--.

Column 16, line 39, after “aid”, insert therefor --of--.

Signed and Sealed this

Seventeenth Day of February, 2009

JOHN DOLL
*Acting Director of the United States Patent and Trademark Office*